US006152451A

United States Patent [19]

Bixby

[11] Patent Number: 6,152,451

[45] Date of Patent: Nov. 28, 2000

[54] VENTILATION DEVICE FOR A GAMING TABLE

[76] Inventor: Robert Brian Bixby, 6448 Lori Ct., Las Vegas, Nev. 89103

[21] Appl. No.: 09/295,740

[22] Filed: Apr. 20, 1999

[51] Int. Cl.[7] ..... A63F 9/00; A47B 25/00

[52] U.S. Cl. ..... 273/309; 454/230

[58] Field of Search ..... 273/309, 292, 273/287; 454/230, 306, 338; 131/231, 242, 238

[56] References Cited

U.S. PATENT DOCUMENTS

| | | | |
|---|---|---|---|
| 3,126,810 | 3/1964 | Karlsson et al. . | |
| 3,422,600 | 1/1969 | Chamberlain . | |
| 4,248,162 | 2/1981 | Skeist | 454/230 |
| 5,301,457 | 4/1994 | Seely | 43/132.1 |
| 5,417,433 | 5/1995 | Phillips | 273/309 |
| 5,441,279 | 8/1995 | Messina | 273/309 |
| 5,542,438 | 8/1996 | Adams et al. | 131/238 |
| 5,562,286 | 10/1996 | Brinket | 454/49 |
| 5,649,997 | 7/1997 | Cavallero et al. | 95/284 |
| 5,775,987 | 7/1998 | Brinket | 273/309 |

*Primary Examiner*—Benjamin H. Layno
*Attorney, Agent, or Firm*—Anderson & Morishita, LLC; Philip J. Anderson

[57] ABSTRACT

A device and improved gaming table are set forth which includes a frame to be mounted in the opening of a table, such as a Blackjack table, adapted to hold the chip rack. The frame has at its perimeter at least one upwardly directed slot. An air supply plenum is provided to supply air from a blower to the frame slot. The supplied air defines an air curtain to isolate the dealer from second hand smoke from the customers. In one embodiment, the frame includes ducts at its perimeter to overlay the table, the ducts including the slots. The slots are disposed at the sides and front of the frame to define a three sided air curtain in front of the dealer's position.

13 Claims, 4 Drawing Sheets

VENTILATION DEVICE FOR A GAMING TABLE

FIELD OF THE INVENTION

The present Invention relates to devices for reducing or eliminating secondhand smoke presented to a dealer at a gaming table.

BACKGROUND

Casinos often present a smoke-filled environment as many patrons enjoy smoking while gambling. For dealers of such games as Blackjack, Baccarat, Pai Gow and the like, those dealers must remain at their positions and stations regardless of the smoking habits of their patrons. Some dealers may experience discomfort or distress as a result of inhaling the secondhand smoke of cigarettes and cigars of their customers.

It has been suggested if riot shown that inhaled secondhand smoke can cause illness including cancer. Thus dealers exposed to secondhand smoke from patrons at their tables may experience the health risks of cancer or other bronchial or pulmonary problems. Furthermore the smoking may irritate the eyes of the dealers and impregnate their clothing with an undesirable odor.

Aside from the illnesses and other effects experienced by the dealers subject to direct secondhand smoke from their customers, illnesses to dealers caused thereby present a cost to the employer by way of lost employee attendance, increased medical costs and premiums as well as perhaps subjecting employers to litigation arising from the environment.

Some approaches have been made to address the problem. One manufacturer, TCS of Las Vegas, Nev. has provided a rail along the dealer's side of the table which includes a number of upwardly directed openings. Air is forced in the rail and through the openings. The drawback of this device is that quite often the dealer will be positioned between the rail and the players and thus the air venting from the rail does not provide any curtain or dilution effect. In fact the air currents created by the upward draft from the rail may tend to draw the smoke into the dealer's face.

In Messina, U.S. Pat. No. 5,441,279, vents are provided at player positions to draw the smoke downwardly, filter it and exhaust the filtered air at the table to the sides of the dealer. A drawback with this design is that, again, the dealer is not isolated from the smoke and in fact the upward draft created by the exhausted air may tend to draw smoke toward the dealer. Still further, the device as described in Messina would not be effective to draw smoke unless the smoking articles are placed close to the table. Thus exhaled smoke from patrons may, as described above, be carried into the face of the dealer. Still a further drawback of this device is that it requires either extensive modifications to an existing gaming table or an entirely new gaming table. This presents an expense which many casinos are not willing to incur.

There is a need for an inexpensive, effective device to attempt to isolate the dealer from smoking patrons. There is especially a need for a device that can be retrofit into existing gaming tables.

SUMMARY OF THE INVENTION

There is, therefore, provided according to the present invention a device which is inexpensive, which is effective to isolate the dealer from the patrons smoke, which is adapted to be used with existing gaming tables, which is unobtrusive and which is capable of being adapted to be retrofit to existing gaming tables.

According to one embodiment of the invention, a device is set forth for a gaming table to reduce smoke experienced by the dealer which includes a frame having an outer dimension to be received in the opening for the gaming table which accommodates the chip or check tray. Thus the chip or check tray of the existing table is removed to receive the frame. The frame includes a structure to receive the stacked chips in the known and conventional manner. The frame includes a perimeter disposed al: the table top having at least one upwardly directed slot positioned to be between the dealer and the players. Air supply means such as a blower and filter are provided as is a plenum to convey the air from the air supply means to the slot. The air exits from the slot to define an air curtain between the dealer and players to isolate the dealer from the players smoke.

Thus, the existing chip tray is removed from the table and the frame is positioned therein. The frame includes a structure to act as the chip tray as well as providing air exhaust slots positioned between the dealer and the players. The air exhausted from the slot on the frame, defines an air curtain between the dealer and players to reduce if not eliminate the smoke experienced by the dealer.

In another embodiment, the device is adapted to be mated with an existing chip tray. The device includes a plenum having a construction to extend about the perimeter of the chip tray. A flange extends from the plenum underneath the flange of the chip tray and is secured thereto. The plenum extends around the edge of the table to be in communication with air supply means. Accordingly, air, which is filtered, is supplied to the plenum below the table and is circulated up above the table to the plenum exposed about the chip tray. The plenum includes one or more slots from which the air is exhausted to define the aforementioned air curtain.

The air exhaust slots may be provided with louvers to turn off or adjust the direction of the exhausted air to a position as desired by the dealer.

Accordingly, the device according to the present invention can be embodied as a substitute for an existing chip tray or can be used to augment an existing chip tray and provide a mechanism by which an air curtain is created to isolate the dealer from the smoking players.

BRIEF DESCRIPTION OF THE DRAWINGS

These and other features and advantages will become appreciated as the same becomes better understood with reference to the specification, claims and drawings wherein:

DESCRIPTION

Figure 1:
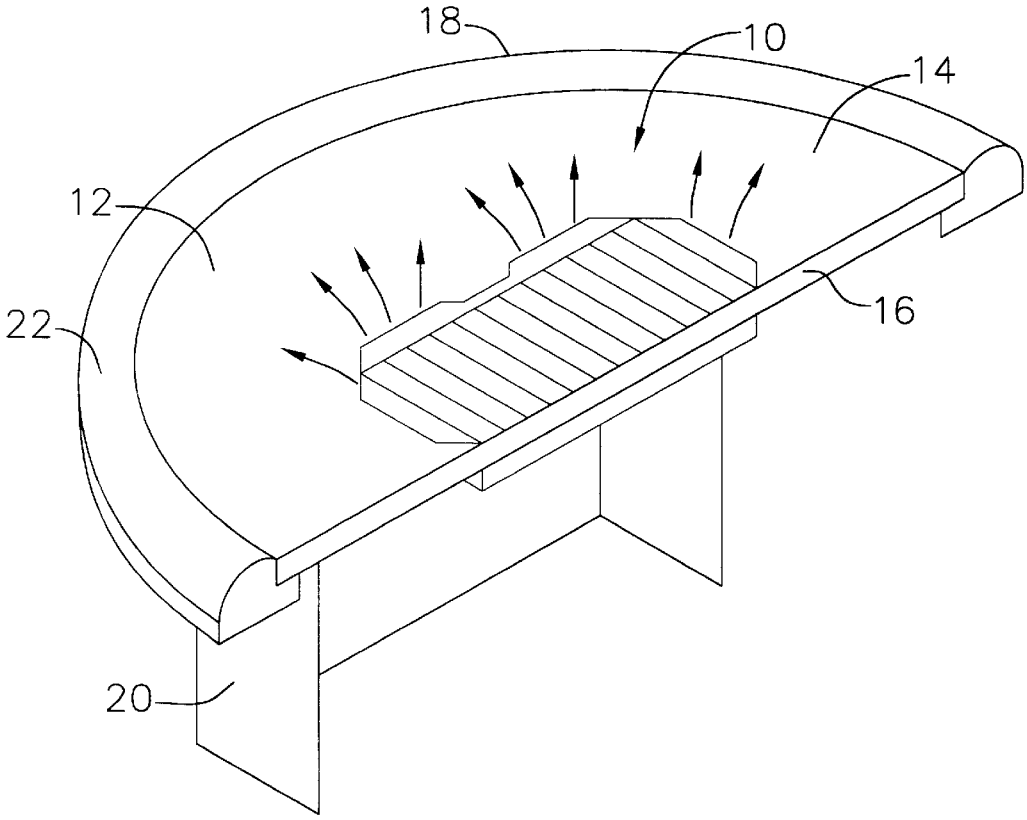
FIG. 1 is a top, rear prospective view of a gaming table including one embodiment of the device according to the present invention.

Turning to FIG. 1, one embodiment of the device 10 installed in a gaming table 12 is illustrated. The gaming table 12 may be of any construction and is shown in FIG. 1 is constructed to represent either a traditional Blackjack, Baccarat, Pai Gow or similar type of table. The gaming table 12 has a top 14 which is semicircular defining a straight edge 16 at the side of the table 12 to be occupied by the dealer and an arcuate portion 18 around which the players are positioned to play the game. In a known manner, the top 14 may include indicia (not shown) to denote the various player positions (typically seven positions for Blackjack) about the portion 18, betting locations, payoffs and the like. The top 14 is supported on a stand 20. About the semicircular portion 18 may be included a pad 22 for the comfort of the players.

As is known, gaming tables of the type shown in FIG. 1 include a chip tray adapted to hold the chips or "checks" used during the play of the game. These trays include arcuate rows each adapted to hold the chips on edge in a stacked relationship. Chips of the same denomination are held in the same row or rows in the tray. The design of the existing chip trays is well known in the art. These chip trays may typically have dimensions of fifteen inches by nine inches up to twenty-eight inches by fifteen inches or larger.

To mount the traditional chip trays in gaming tables, an opening is provided into which the chip tray is positioned. A flange about the perimeter of the existing chip tray supports the tray at the top whereas fasteners are secured between the chip tray and table top to hold it in position.

Figure 7:
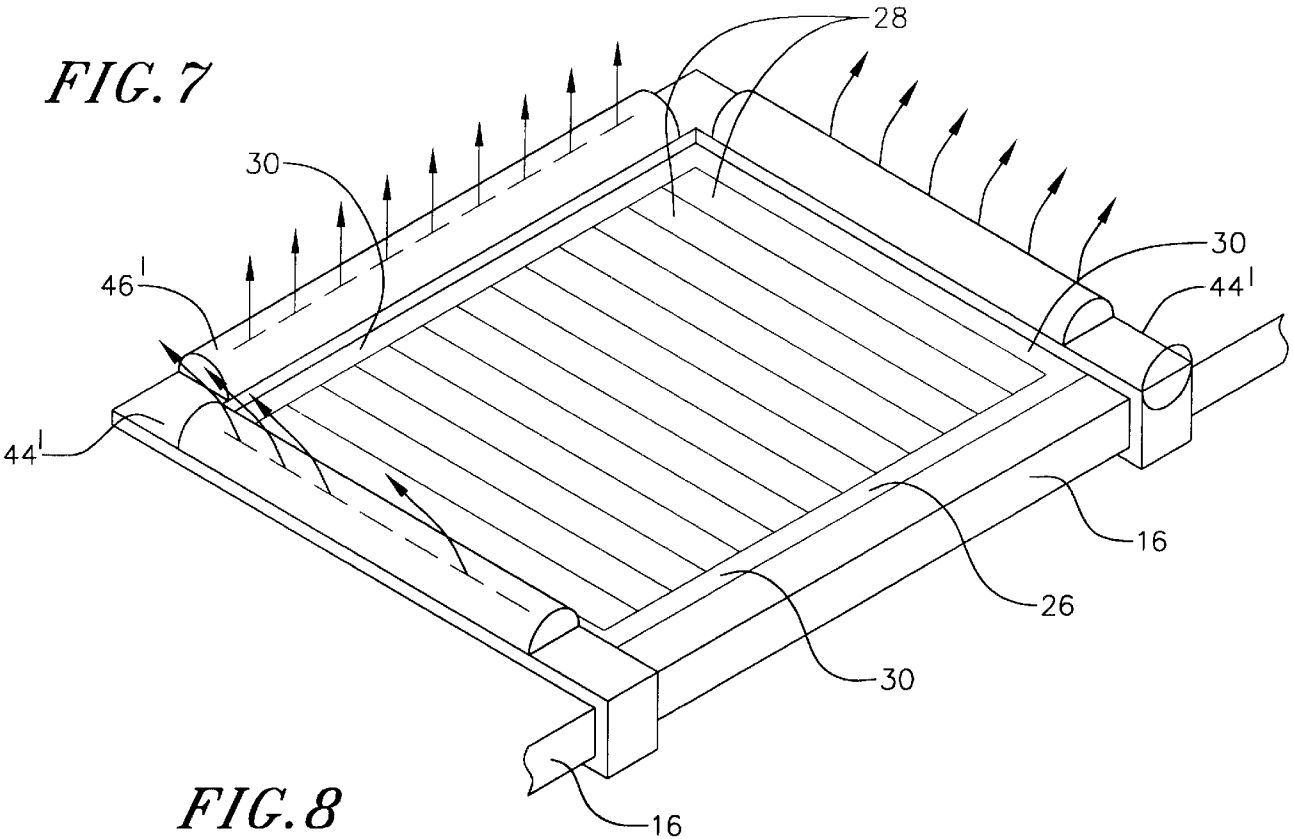
FIG. 7 shows yet another embodiment of the device according to the present invention.

With reference to FIG. 7, a typical known and existing chip tray 26 is illustrated in connection with yet a further embodiment of the device according to the present invention. As shown, the chip tray includes the arcuate rows 28 adapted to hold and receive chips as well as the perimeter flange 30 to support the chip tray 26 on the table top 14.

According to one embodiment of the present invention, the device 10 is adapted to replace the existing chip trays for a gaming table 12. While the device 10 may be offered as original equipment for new gaming tables, it is particularly suited to replace the chip trays 26 on existing tables on the casino floor.

Figure 2:
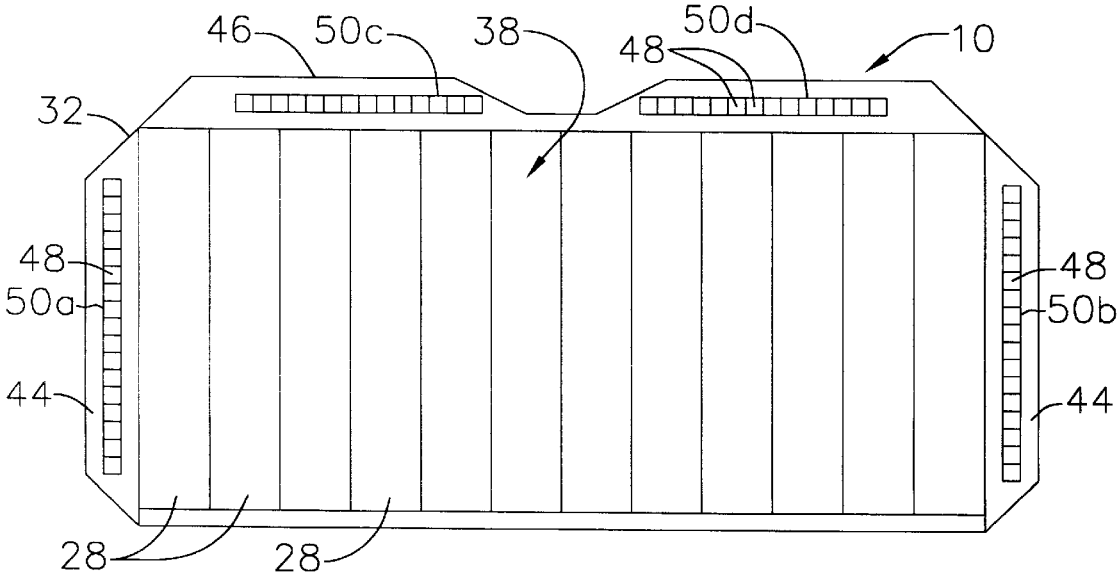
FIG. 2 is a top view of the device according to one embodiment of the present invention.
Figure 3:
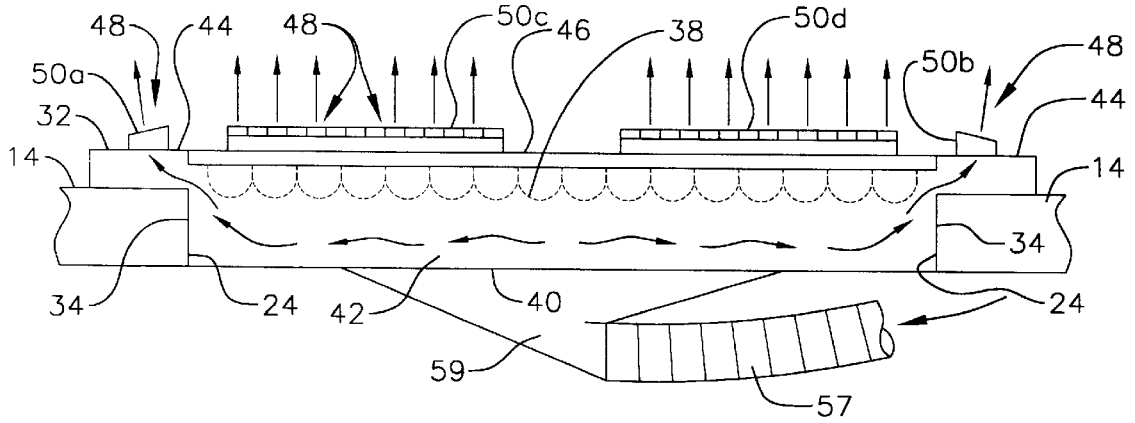
FIG. 3 is a rear view of the device of FIG. 2.
Figure 4:
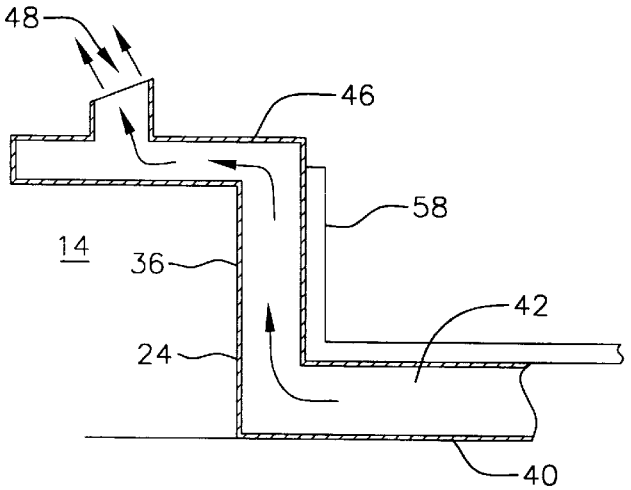
FIG. 4 is a side section view of a portion of the device of FIG. 2.

As shown in FIGS. 2–4, the device 10 has a substantially rectangular frame 32 including the rows 28 to hold chips and is adapted to be received in the opening 24 previously occupied by an existing chip tray 26. Accordingly, the frame 32 has perimeter side walls 34 and end walls 36 which provide the rectangular profile for the frame 32 and are adapted, as shown in FIGS. 3 and 4, to be closely received within the opening 24 previously occupied by the existing chip tray 26. The frame 32 also includes a closed top surface 38 (including the arcuate rows 28) and a bottom wall 40. Between the bottom wall 40 and top surface 38 there is defined a closed plenum 42 the purposes here and which will hereinafter become evident.

At the sides and forward edge of the frame 32 are located side and forward ducts 44, 46 respectively. The side and forward ducts 44,46 project as flanges for the frame 32 to overlay the tabletop 14 as shown in FIG. 3 and are flat as well as hollow. As shown in FIGS. 3 and 4, the side and forward ducts are in communication with the plenum 42 defined between the top surface 38 and bottom wall 40.

The side and forward ducts 44,46 are positioned about the perimeter of the frame 32 and thus are disposed to be in a position between the dealer and the players seated at the table 12 as shown in FIG. 1. To provide a air curtain between the dealer, whose body and face would be disposed over the frame 32, the side and forward ducts 44,46 include a plurality of upwardly directed slots 48. As shown in FIGS. 3 and 4, the slots may be included in upwardly projecting grates 50*a,b* at the side ducts 44 positioned to direct the air outwardly from the chip tray rows 28 and the grates 50*c,d* at the forward ducts 46 may be vertical or slightly angled to be directed away from the side 16 and the dealer. Preferably the slots 48 are sufficiently small so that chips or checks may not be dropped therethrough.

Figure 8:
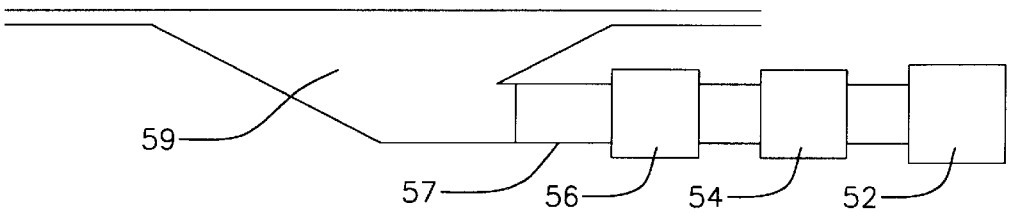
FIG. 8 illustrates the air supply means for the device according to the present invention.

The plenum 42 of the frame 32 is in communication with air supply means as illustrated in FIG. 8. Thus, the device 10 further includes an air blower 54 and may further include a HEPA filter 52 to filter the air discharged by the air blower 54. Preferably the air blower 54 and filter 52 are disposed underneath the tabletop 14 to be easily accessible but unobtrusive. If desired, the air supply means may also include humidifying means shown as a humidifier 56 and may also include, if desired, a heater to warm the air supplied by the air blower 54. A conduit 57 supplies the air from the air blower 54 and filter 52 to a supply duct 59 which supplies the air to the plenum 42. The air blower 54 is electrically operated and is powered from an auxiliary source such as through a three phase, 110 volt power cord.

When a dealer encounters smoking players at his table and is irritated by the smoke, he/she activates the device 10 by turning on the air blower 54. The air is drawn from underneath the table (relatively smoke free due to the ventilation in the casino) is passed through the filter 52 (and humidifier and/or heater) and is supplied to the supply duct 59. As shown in FIG. 3, from the supply duct 59, the air is circulated by the plenum 4:2 to the side ducts 44 and forward ducts 46. The air exhausts from the slots 48 in an upward direction between the dealer and players to define an air curtain to isolate the dealer from the smoke of the players. Preferably the flow of air should be at such a rate and condition to produce an air curtain extending approximately three feet above the table top 14.

As can be appreciated, the air curtains provided by the device 10 isolate the dealer's face, usually presented over the rows 28 of the device 10, from smoke emanating from players either in front of the dealer or to the sides.

If desired, the device 10 may include louvers (not shown) for the slots 48 to control the direction of the air, emitted therefrom and to, if desired, turn off flow from one or more of the slots, such as, for example, if the table is only occupied by a player to one side of the dealer. Still further, the blower 54 may be variable speed and the dealer can adjust the volume of flow and thus the configuration of the air curtain by adjusting the speed of the blower 54.

While the frame 32 may be fashioned entirely from aluminum or the like, as suggested in FIG. 4, the device 10 may include the plenum 42 and side ducts 44 as well as forward ducts 46 manufactured from a durable and rugged plastic material with an insert 58 fashioned from aluminum and defining the rows 28 to retain the chips. As is known in the art, dealers receiving tips, often signify this by tapping the chips against the margins or chip tray. Thus by providing the plenum 42, side ducts 44 and forward ducts 46 as replaceable plastic, these components can be removed and replaced when they become damaged. Furthermore, the plastic defining the plenum 42, side ducts 44 and forward ducts 46 may be fashioned from pleasing and striking colors enhancing the appearance of the table 12.

Figure 5:
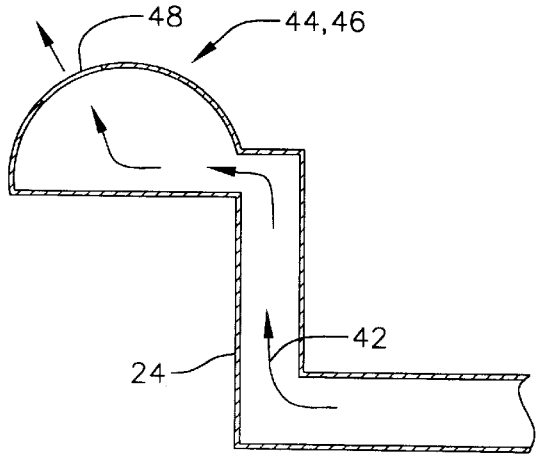
FIG. 5 is a side section view of the device of FIG. 2 showing a modification thereof.

With reference to FIG. 5, the device 10 may include semicylindrical side and forward ducts 44, 46 to protect the dealer's hands from sharp edges and enhancing the pleasing appearance of the device 10. Preferably the semicylindrical side and forward ducts 44, 46 are smooth to prevent injury to the dealer.

Figure 6A:
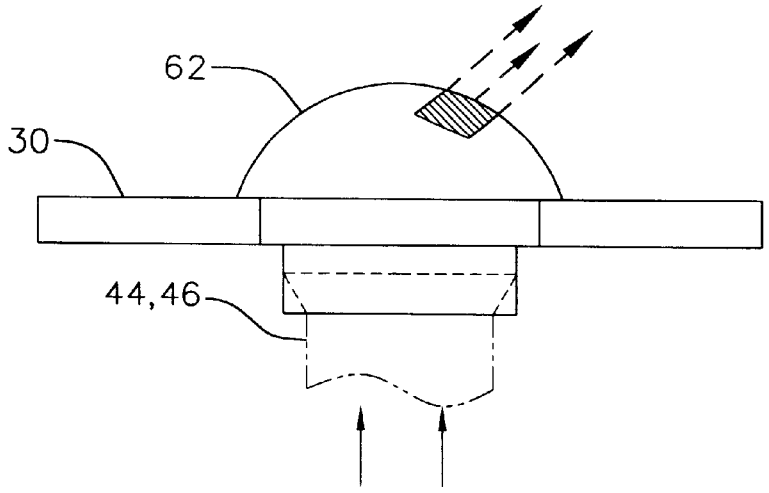
FIGS. 6A and 6B disclose a further embodiment of the present invention.
Figure 6B:
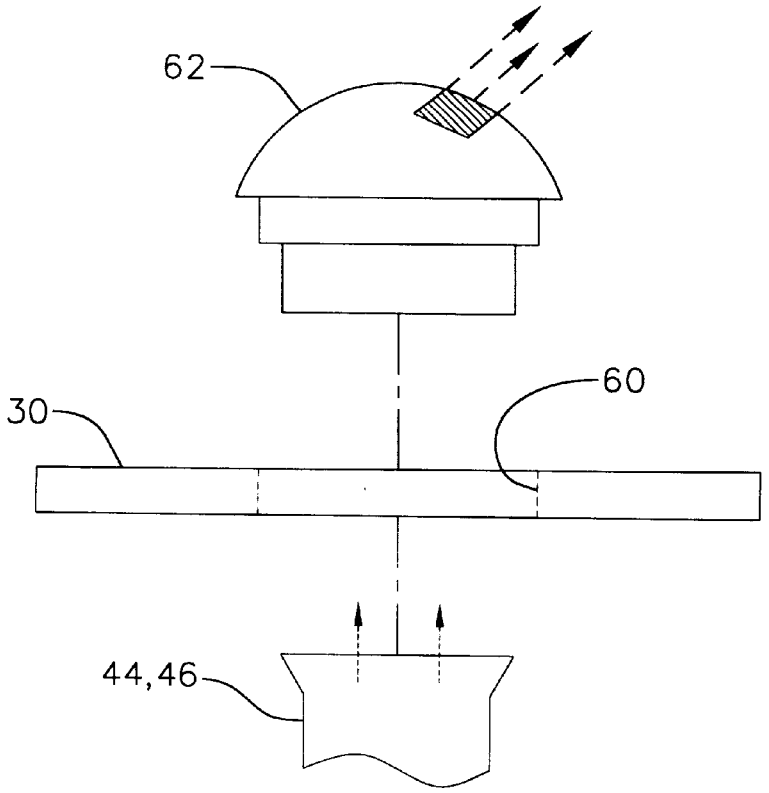

Turning to FIGS. 6A, 6B , yet a further embodiment of the device is shown. According to this embodiment, the device 10 includes a flange 30 projecting outwardly from the chip tray 26 to overlay the table top 14. Below the flange 30 and recessed within the opening 24 are side and forward ducts 44,46. The flange 30 includes openings 60 through which are received replaceable heads 62 which may include the rounded configuration as shown in FIG. 5. The heads 62 register, connect and seal with the ducts 44, 46. Accordingly, if the heads 62 become worn or damaged they may be removed and replaced.

Turning to FIG. 7, yet another embodiment of the device is shown which is adapted to be retrofit in existing chip trays 26. According to this embodiment, the device 10' includes side and forward ducts 44',46' which are connected and extend about the perimeter of the existing chip tray 26. These side and forward ducts 44',46' may be held in position as by being secured to the existing chip tray, having an edge adapted to be exposed underneath the flange 30 of the chip tray 26 or simply independently secured to the table 12. As shown in FIG. 7, the side ducts 44' extend about the edge 16 to position underneath the tabletop 14 for connection to a supply duct 57, air blower 54, filter 52 and if desired, humidifier 56 and heater. Air drawn in by the air blower 54 is circulated up through the side ducts 44' to the forward duct 46' and is exhausted from the slots 48 in the manner described above.

While I have shown and described certain embodiments of the present inventions, it is to be understood that it is subject to many modifications and changes without departing from the spirit and scope of the appended claims.

I claim:

1. A device for a gaming table to reduce smoke inhalation by a dealer wherein said table has a top, a side to be occupied by the dealer, and an opening in the table to mount a chip tray in front of the dealer, said device comprising:

a frame having outer dimensions to be received in said opening for said chip tray, said frame including perimeter disposed at the table top having at least one upwardly directed slot;

air supply means;

a plenum to convey air from the air supply means to said slot, said air exiting said slot to define an air curtain between the dealer and the players.

2. The device of claim 1 wherein said frame is rectangular.

3. The device of claim 2 wherein said frame includes a plurality of upwardly directed slots to direct air to define a multi-sided air curtain between the dealer and players.

4. The device of claim 3 wherein said frame includes slots to direct air to define a three sided air curtain.

5. The device of claim 1 further including means for directing the air exiting the slot.

6. The device of claim 5 wherein the air directing means include louvers disposed at the exit of said slot.

7. The device of claim 6 including means for adjusting the position of said louvers.

8. The device of claim 1 inducing means for conditioning the air.

9. The device of claim 8 wherein said conditioning means includes an air filter.

10. The device of claim 8 wherein said conditioning means includes a humidifier.

11. The device of claim 8 wherein said conditioning means includes a heater.

12. A device for a gaming table to reduce smoke inhalation by a dealer wherein said table has a top, a side to be occupied by the dealer, and an opening in the table to mount a chip tray in front of the dealer, said device comprising:

a frame having an outside dimension to be received and mounted in said table opening, said frame including a chip rack and a flange at the perimeter to overlay the table top, said flange having at least one upwardly directed slot;

an air blower;

a plenum to supply air from the blower to said slot, said air exiting the slot defining an air curtain between the dealer and players.

13. An improved gaming table defining at one edge thereof a dealer position and at an opposite edge one or more player positions, a table top and an opening proximate the dealer position to receive and mount a chip tray, said gaming table comprising:

a frame body having an outer dimension to be disposed about the perimeter of the chip tray, said frame having at least one vent located between the dealer position and the player position;

means for securing the frame to the table;

a blower;

a plenum to supply air from the blower to the frame, said air exhausting from said vent to define an air curtain between the dealer and the player(s).

* * * * *